United States Patent [19]

Bradley

[11] 4,181,300

[45] Jan. 1, 1980

[54] GOLF TEE

[76] Inventor: Arthur S. Bradley, 342 N. 116th St., Wauwatosa, Wis. 53110

[21] Appl. No.: 843,503

[22] Filed: Oct. 19, 1977

[51] Int. Cl.[2] ..... A63B 57/00

[52] U.S. Cl. ..... 273/33

[58] Field of Search ..... 273/33, 26 R, 183 A, 273/212, 196, 195, 197, 198, 202-211; 34/5 GT

[56] References Cited

U.S. PATENT DOCUMENTS

| | | | |
|---|---|---|---|
| 558,433 | 4/1896 | Stoddard | 273/33 |
| 1,596,110 | 8/1926 | Lynch | 273/33 |
| 2,128,049 | 8/1938 | Karkoska | 273/33 |
| 2,705,003 | 3/1955 | Schensted | 273/26 R |
| 3,039,770 | 6/1962 | Ferretti | 273/26 R |
| 3,300,219 | 1/1966 | Sipos | 273/196 |
| 3,883,144 | 5/1975 | Lazow | 273/33 |
| 3,899,179 | 8/1975 | Vlach | 273/208 |

*Primary Examiner*—Richard C. Pinkham
*Assistant Examiner*—T. Brown
*Attorney, Agent, or Firm*—John J. Byrne

[57] ABSTRACT

A golf ball tee comprising a horizontal "T" shaped support, downwardly extending legs at each extremity of the support operable to stably engage a ground surface and a golf ball supporting stanchion projecting upwardly from the "T" shaped support to support a gold ball to be driven.

1 Claim, 5 Drawing Figures

GOLF TEE

BACKGROUND OF THE INVENTION

This invention relates to an improved golf tee for use in supporting a golf ball to be driven.

In the past golf tees typically have been fabricated from a wooden member pointed at one end for insertion into a ground surface and gradually widening at an opposite end to form a generally round pedestal for supporting a golf ball.

Although such tees are inexpensive and widely utilized there are a number of disadvantages in their use. First such tees are easily broken by the shoe of the driver. If the tee is not broken it is often kicked off the driving tee in the direction of the shot and is lost in the grass. It is not unusual to break or lose a tee every hole or every other hole.

Additionally wooden tees are somewhat difficult to insert into a dry teeing area with sufficient depth to stably support a ball. Still further such tees promote a degree of inconsistent depth placement which affects the height at which the ball sits.

Some of the foregoing breaking diffficulties are alleviated by utilizing plastic tees. Plastic tees, however, still have most of the foregoing disadvantages as well as tending to bend upon insertion into the ground.

The difficulties suggested in the preceding are not intended to be exhaustive, but rather are among many which have tended to reduce the effectiveness of previously known teeing devices. Other noteworthy problems may also exist; however, those presented above should be sufficient to demonstrate that conventional wooden or plastic golf tees will admit to worthwhile improvement.

OBJECTS OF THE INVENTION

It is therefore a general object of the invention to provide a novel golf tee which will obviate or minimize problems of the type previously described.

It is a particular object of the invention to provide a novel golf tee which can not be easily broken or lost.

It is another object of the invention to provide a golf tee which provides a stable support for a golf ball without requiring insertion into a ground surface.

It is a further object of the invention to provide a golf tee which provides a uniform height to a golf ball above a ground surface.

It is yet another object of the invention to provide a golf tee which provides a degree of alignment for a golfer down a fairway as he tees up the ball.

THE DRAWINGS

DETAILED DESCRIPTION

Figure 1:
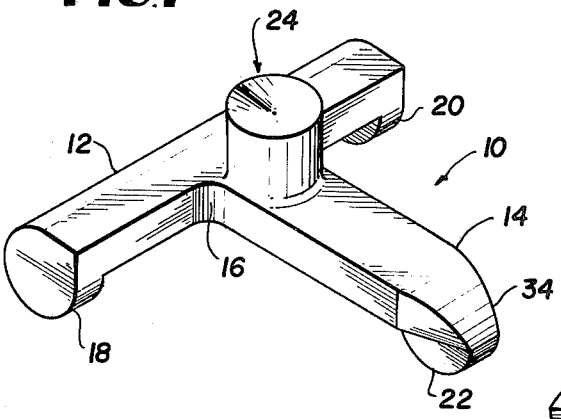
FIG. 1 is a perspective view of a golf tee in accordance with applicant's invention.

Referring now to the drawings, wherein like numerals refer to like parts, FIG. 1 is an axonometric view of a golf tee 10 in accordance with a preferred embodiment of the invention.

The tee 10 includes a first horizontal support 12 and a second horizontal support 14 joining at one end 16 with a mid portion of the first support to form a general "T" shaped support structure.

A pair of downwardly extending legs 18 and 20 extend from either end of the first support 12. In a similar manner a downwardly extending leg 22 extends from the free end of the second support 14.

Figure 2:
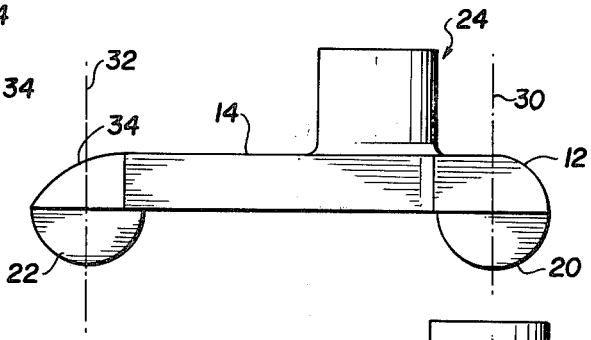
FIG. 2 is a side elevational view of the golf tee depicted in FIG. 1.
Figure 3:
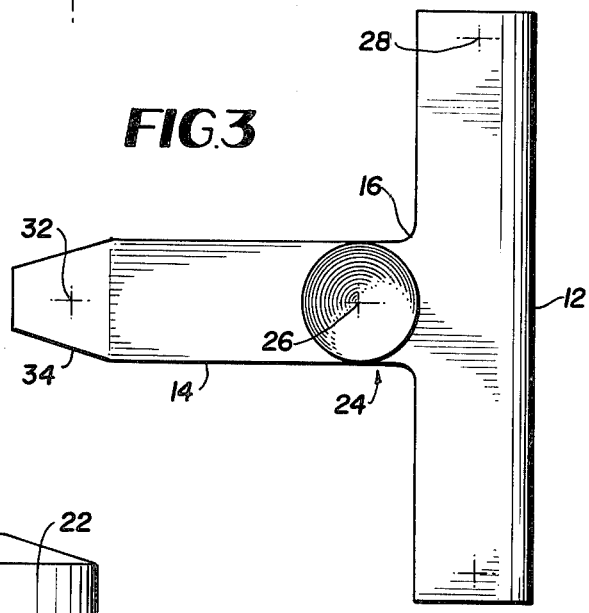
FIG. 3 is a top view of the golf tee depicted in FIG. 1.
Figure 4:
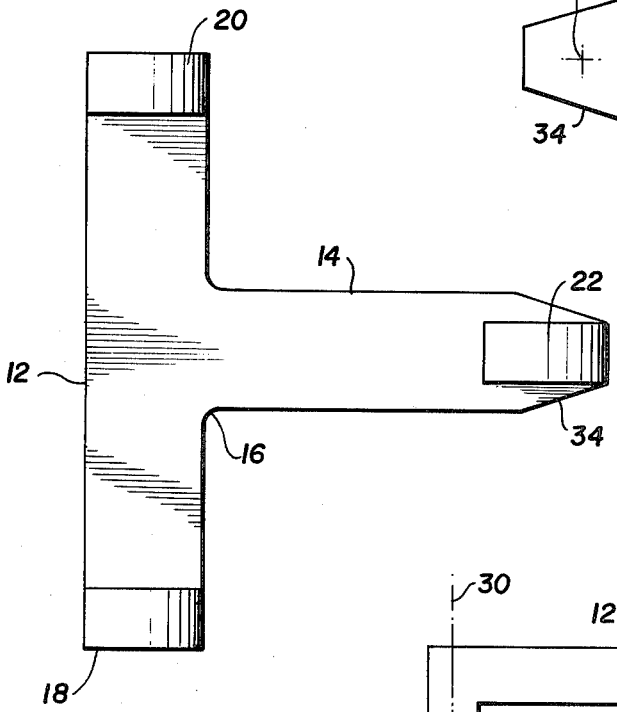
FIG. 4 is a bottom view of the golf tee depicted in FIG. 1.
Figure 5:
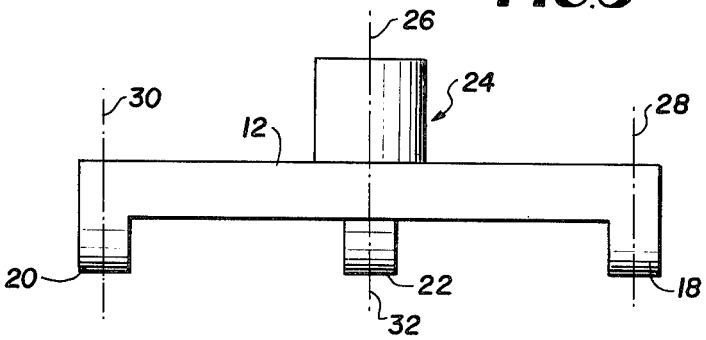
FIG. 5 is a back view of the golf tee depicted in FIG. 1.

The legs 18, 20 and 22 each have a semicircular configuration, note FIG. 2, and provide point contact with a ground surface. This point contact enables the "T" shaped support to be stably positioned upon a three point stance. Accordingly grass, dirt, etc. may be under the support arms of the tee without disturbing the stability of the tee.

A ball supporting stanchion 24 extends upwardly from the "T" shaped support and preferably comprises a solid right cylinder with a generally conical depression in the upper portion thereof to accommodate an arcuate portion of a ball resting upon the tee.

The stanchion 24 is positioned upon the "T" shaped structure in a posture wherein a central longitudinal axis 26 is equidistantly spaced from parallel axes extending through the bearing points 28, 30 and 32 of each of the semicircular disc members 18, 20 and 22 respectively. Accordingly the weight of the ball is equally distributed to each of the bearing points to enhance level stability of the tee.

Finally the free end of the second support 14 is tapered as at 34. This taper provides a general line of straight guidance over the stanchion 24 and down the support 14 to assist in lining up the golfer's tee shot.

In describing the invention, reference has been made to a preferred embodiment. Those skilled in the art, however, and familiar with the disclosure of the subject invention, may recognize additions, deletions, modifications, substitutions and/or other changes which will fall within the purview of the invention as defined in the following claims.

What is claimed is:

1. A golf ball tee comprising:

a first horizontal support;

a second horizontal support normally connected to said first horizontal support to form a generally "T" shaped structure;

a downwardly extending leg fashioned at one end of said first horizontal support; said leg comprising a first semicircular disc member positioned transverse to a longitudinal axis of said first horizontal support wherein the periphery of said disc member operably bears upon a ground surface;

a downwardly extending leg fashioned at the other end of said first horizontal support; said leg comprising a second semicircular disc member positioned transverse to the longitudinal axis of said first horizontal support wherein the periphery of said disc member operably bears upon a ground surface;

a downwardly extending leg fashioned at the free end of said second horizontal support; said leg comprising a third semicircular disc member positioned in alignment with the longitudinal axis of said second horizontal support, said first, second and third semicircular disc members combining to operably form a stable three point bearing contact with a ground surface and being longitudinally directed in the intended line of flight of a golf ball supported upon the golf tee;

a solid right cylindrical golf ball supporting stanchion integrally fashioned with said first and second horizontal support members and projecting above a surface plane of said first and second horizontal support members, said solid right cylinder terminating in an inwardly directed cone whereby a golf ball may be operably supported upon a peripheral base portion of the inwardly directed cone;

said solid right cylindrical golf ball supporting stanchion having a longitudinal axis and said stanchion being positioned upon said second horizontal support member wherein said axis is equidistantly spaced from mutually parallel axes extending through the bearing point of each of said semicircular disc members; and the end most portions of said first horizontal support being terminated with a substantially planar surface transverse to a longitudinal axis of the support and mutually parallel with an intended line of flight of a golf ball and the end most portion of said second horizontal support being tapered toward the end thereof in the direction of the intended line of flight of a golf ball struck from said golf ball tee.

* * * * *